US005791537A

United States Patent [19]

Miller

[11] Patent Number: 5,791,537

[45] Date of Patent: Aug. 11, 1998

[54] COMBINATION BACKPACK AND QUIVER

[76] Inventor: Arlyn E. Miller, P.O. Box 191, Boise City, Okla. 73933

[21] Appl. No.: 506,665

[22] Filed: Jul. 25, 1995

[51] Int. Cl.[6] ..... A45F 3/04

[52] U.S. Cl. ..... 224/583; 224/652; 224/645; 224/628; 224/916

[58] Field of Search ..... 224/917, 913, 224/916, 915, 153, 581, 582, 583, 603, 605, 627, 645, 650, 651, 652, 654, 655, 656, 657, 658, 659; D3/216, 217, 222, 262

[56] References Cited

U.S. PATENT DOCUMENTS

| | | | |
|---|---|---|---|
| 2,781,808 | 2/1957 | Barnard . | |
| 2,872,959 | 2/1959 | Stockfleth . | |
| 2,881,817 | 4/1959 | Brion . | |
| 2,897,864 | 8/1959 | Schmidt . | |
| 3,465,928 | 9/1969 | Osterholm . | |
| 3,973,776 | 8/1976 | Ogle . | |
| 4,068,314 | 1/1978 | Yellen | 224/655 |
| 4,073,328 | 2/1978 | Franklin . | |
| 4,518,107 | 5/1985 | Amos | 224/153 |
| 5,129,560 | 7/1992 | Herman | 224/153 |
| 5,509,589 | 4/1996 | Kilot | 224/656 |

FOREIGN PATENT DOCUMENTS

| | | | |
|---|---|---|---|
| 57338 | 2/1940 | Denmark | 224/209 |
| 612489 A1 | 8/1994 | European Pat. Off. | 224/917 |
| 1010467 | 6/1952 | France | 224/209 |
| 2631792 | 12/1989 | France | 224/209 |
| 2706263 | 12/1994 | France | 224/153 |
| 222777 | 5/1985 | Germany | 224/153 |
| 48230 | 8/1930 | Norway | 224/209 |
| 53226 | 10/1933 | Norway | 224/209 |
| 154365 | 7/1932 | Switzerland | 224/209 |
| 19949 | of 1891 | United Kingdom | 224/209 |
| 1009398 | 11/1965 | United Kingdom | 224/209 |

OTHER PUBLICATIONS

"Bear Archery Equipment" 1957 Catalog; emphasis on p. 16.

*Primary Examiner*—Henry T. Recla
*Assistant Examiner*—Gregory M. Vidovich
*Attorney, Agent, or Firm*—Novak Druce & Burt

[57] ABSTRACT

The present invention is a pack to be carried on a person's back and includes a packable compartment having an inwardly slanting back surface upon which accessories may be mounted so that at least a portion of the mounted accessory will be located proximate to the carrier's shoulder and within easy over-the-shoulder reach by the carrier. It also provides a means by which the rotational orientation of the accessory may be varied with respect to the compartment to further enhance the combination's ability to place mounted accessories proximate the carrier's shoulder and facilitate right and left handed users. In one embodiment, the accessory is a quiver used to carry arrows. Still further, the present invention may be variably configured to conform to different persons' body structure and posture.

16 Claims, 3 Drawing Sheets

COMBINATION BACKPACK AND QUIVER

FIELD OF THE INVENTION

The present invention relates generally to packs carried on the back of a user. More particularly, it relates to backpacks designed to have accessories carried thereon and oriented so that either the accessory itself, or items carried therein, are easily accessible to the user while being carried upon the back.

BACKGROUND OF THE INVENTION

The use of bows and arrows is a long known means employed for hunting. Bow hunting, and the skills associated therewith, however, are enjoying a gain in popularity, as a sport. The sport may be exercised either in the form of a hunt or in target shooting. As a result, the equipment that is used in bow hunting, which includes bows, quivers, and an assortment of arrows has also received additional attention. Some of the equipment has been redesigned or refined to make it more effective and to facilitate its use.

In the case of actual hunting, a hunter will usually seek out game in uninhabited areas. Because the areas are often rugged and remote, the hunter may be required to carry supplies and camping gear, together with hunting gear on his or her back. Backpacks are typically used to organize the equipment and facilitate its portage. In the case of bow hunting, the hunter may desire to have the bow, and particularly the arrows handily available during travel in the event that game presents itself along the trail or they are needed for defensive purposes. Quivers have been developed as carrying assemblies for arrows. Most quivers are designed to be closed at one end and open an opposite end. The arrows are held within the quiver with one end of the arrow extending therefrom. The quiver is normally provided with a shoulder strap assembly that it may be placed over the hunter's shoulder and carried in the fashion of a backpack. In those designs in which the quiver is mounted to a back side of the carrying compartment and distanced from the hunter, it may be difficult to access the quiver's arrows.

One United States patent that has issued concerning a device that combines a pack frame with a quiver is U.S. Pat. No. 3,973,776 to Ogle for an Arrow Quiver And Pack Frame. Ogle includes disclosure of a pack frame that houses a quiver. The pack frame has two rectangularly shaped planer members pivotally connected at their top ends. Extending or opening one of the planer members outwardly exposes a quiver housed between the two planer members; the quiver holds a plurality of arrows. Several cloth pockets are attached to the outside of the frame for holding camping supplies. If the planar member is extended during travel to expose the arrows contained therein, passage through the undergrowth may be inhibited. Still further, the quiver is not detachable from the backpack; thus the frame must be carried at all times with the quiver while hunting.

Previously patented quiver and pack assemblies embody deficiencies that are obviated by the present invention. An example of one such deficiency is the apparent difficulty in retrieving arrows from the quiver while wearing the pack frame. The difficulty stems from the thickness or depth of the pack which causes the quiver to be located further behind the carrier's shoulder than can be comfortably reached, if at all. This makes it difficult for a hunter to reach behind his back and remove an arrow for loading into the bow.

Since both quivers and backpacks of conventional design rest on the hunter's back, a present need exists for a pack having a packable compartment and quiver combined that is designed to allow access to the quiver while being carried. Because the packable compartment will normally be the heavier of the two components, the pack should be designed so that the compartment is nearest the person's back, and preferably resting thereupon. The lighter quiver may be mounted to a backside of the compartment and more distanced from the carrier.

SUMMARY OF THE INVENTION

The pack made according to the present invention, and the method for providing the same alleviates the outlined problems associated with previously known backpack-quiver combinations. The packable compartment, also referred to herein as a closeable compartment, is specially shaped to rest against the carrier's back and by doing so establishes a slanted back surface. The back surface slants towards the carrier's shoulders. To achieve this, the compartment is constructed so that the depth at the lower end of the compartment is greater than the depth at the upper end. This causes the back side of the compartment to slant inward toward the carrier from the bottom to the top. The slanted back side presents a surface upon which accessories such as the hunter's quiver may be mounted. When the accessory is attached so that it is parallel with the back side, a top end of the accessory is also canted toward the shoulders of the carrier. To maintain this configuration, the compartment is constructed from material of sufficient rigidity to resist significant deformation.

The compartment having a canted back surface is a unique improvement to known backpacks. By presenting such a mounting surface, items may be fixed to the compartment for ready use by the carrier while in transit. As an example, a hand axe could be lashed or held in a sheath on the back surface of the compartment with the handle of the axe positioned near the carrier's shoulder. As the carrier approaches an obstruction, he or she may reach over their shoulder and grasp the axe's handle. The axe may then be pulled from its holder and used as needed. It may then be placed back upon the compartment for continued travel without requiring that the carrier hold the axe in-hand between uses.

The accessory may be angled so that an upwardly extending portion of the accessory extends toward the right or left of the carrier. Once again, the example of an axe handle illustrates that slanting the upper end of the handle to the right would further facilitate its grasp by the carrier's right hand while a slant to the left would facilitate its being grasped by the left hand.

These same features enhance the useability of a quiver when attached to the back surface of the compartment. As explained, a hunter will want to have the arrows being carried in the quiver accessible during travel. Therefore, the ends of the arrows that are extending above the quiver must be located sufficiently near to the hunter's shoulder to allow easy over-the-shoulder grasp by the hunter. This is achieved by the inwardly canted back surface of the compartment. Furthermore, the hunter may be either right-handed or left-handed and therefore the ability to turn the quiver upon the compartment is also beneficial. This is particularly true where the quiver is sufficiently wide to cause arrows to be placed directly behind the head of the hunter where their grasp would be difficult. Still further, if the slant of the back surface is sufficiently great, the arrows could extend against the hunter's head and become an irritant if not slanted to the side so that they are located over the hunter's shoulder.

Because the quiver of the present invention is releasably connected to the packable compartment, it may be detached and carried independently therefrom. Strap couples, or connections are provided upon the quiver for attaching shoulder straps directly thereto. This facilitates accessibility during travel while the quiver is mounted behind the compartment, and it also makes it possible for the hunter to carry just the lighter quiver when the pack is not needed. This might be on shorter hunting excursions when a packable compartment is not needed, or after a camp has been established and the hunter is operating from the camp base.

The connection for the quiver to the compartment is adjustable so that the orientation of the quiver with respect to the compartment may be adjusted and varied. This is important if the combination is to be used by more than one person. In the illustrated embodiment of the invention, leather thongs are used to tie the compartment and quiver together. As an example, the quiver in FIG. 2 is connected at four points by leather thong ties. To adjust the orientation of the quiver, the thongs attached to the quiver may be variably joined to different thongs at different locations upon the back surface of the compartment. Alternatively, some mated sets of thongs maybe tied more closely while others are tied at greater lengths. It is contemplated that any means for varying the relative rotational orientation of the quiver with respect to the packable compartment will be suitable. To this end, it is envisioned that a plurality of snap-halves may be provided upon the compartment and to which mating halves on the quiver may be selectively engaged. By engaging different snap-halves on the compartment, the quiver may be variably positioned.

The spacing member, or members oriented between the front and back sides of the compartment are variably selectable so that the relative orientation of the two sides of the compartment may be altered. In the illustrated embodiment, the spacing members take the form of side panels to the compartment that may be differently sized and/or shaped to produce different configurations between the sides. The compartment may be customized to the particular curvature of the carrier's back and also appropriately sized for comfort and location upon the back. In the illustrated embodiment of the present invention, the side panels are releasably stitched to the front and back panels. If required, the side panels can be exchanged and the lap of the flap closure adjusted to compensate for either reductions or surplusage in the body of the compartment.

It is also contemplated that the shoulder strap(s) may be detachably connectable to both the packable compartment and the quiver. In this configuration, the straps may be exchanged for use on either the compartment or quiver, or their combination.

An alternative embodiment of the invention has a rigid frame encased within a flexible shell. In this case, the frame establishes the shape of the compartment and properly positions any accessories attached thereto. The orientation of the packable compartment may be varied by selecting different sized and shaped frames. The ability to sidewardly orient a quiver upon a back surface of the compartment may be similarly achieved, as may changing the angle at which the quiver is slanted toward the carrier's shoulders.

This invention includes several components that have been individually selected for their combined benefits and tailored into a system that delivers superior performance as a backpack quiver. In one embodiment of the present invention, a pack to be carried on a person's back is provided. The pack includes a closeable compartment that is suitable for having accessories mounted on a back side thereof. The closeable compartment has an upper and lower end, and a front side having a front exterior surface for resting upon a carrying person's back. The compartment also has a back side with a back exterior surface, where the back side is oriented for location away from the carrying person's back. There are carrying straps coupled to the closeable compartment for holding the pack upon the person's back and locating the upper end of the closeable compartment proximate to his or her shoulder(s). At least one spacing member is coupled between the front side and the back side of the compartment for orienting the back exterior surface with respect to the front exterior surface. In this arrangement, the back exterior surface is oriented at a prescribed angle with respect to the front exterior surface so that an upper end of the back exterior surface is located closer to the front exterior surface than a lower end of the back exterior surface. The prescribed angle is of sufficient degree to assure that accessories coupled to and substantially parallel with the back exterior surface and extending thereabove will be canted forward and at least partially located within easy over-the-shoulder grasping reach of the carrying person when the pack is being worn.

In one embodiment of the spacing member, a first side panel establishes a first exterior side of the pack and the first side panel is constructed from material sufficiently rigid to establish and maintain the prescribed angle between the front and back exterior surfaces.

Still further, the spacing member includes a second side panel oppositely oriented to the first side panel. The second side panel establishes a second exterior side of the pack and is also constructed from material sufficiently rigid to establish and maintain the prescribed angle between the front and back exterior surfaces.

The first and second side panels are selectable with respect to size and shape thereby allowing the orientation of the back exterior surface to be adjustable. Further, the first and second side panels are constructed from leather.

In an additional embodiment of the present invention, the pack further includes a quiver releasably coupled to the back side of the closeable compartment and positioned thereupon so that a longitudinal axis of the quiver is oriented substantially parallel to the back exterior surface of the closeable compartment. An upper end of the quiver is forwardly positioned with respect to a lower end of the quiver.

The longitudinal axis of the quiver is sidewardly oriented at an angle transverse to vertical.

It is contemplated that the invention may include a quiver coupler wherein the quiver coupler allows adjustable positioning of the quiver with respect to the closeable compartment. As a result, the upper end of the quiver may be rightwardly or leftwardly positioned with respect to a lower end of the quiver.

In those embodiments including a quiver, it is further contemplated that at least one arrow may be positioned therein. A lower end of the arrow is contained within the quiver and an upper end extends above the closeable compartment. In yet another embodiment, the upper end of the arrow extends forward of the front exterior surface of the closeable compartment. In all likelihood, this positions the top end of the arrow above the shoulder of the carrying person.

In those embodiments including a quiver, a strap coupler is included for coupling a carrying strap thereto so that the quiver may be carried independently of the closeable compartment.

The upper end of the quiver tapers down to the lower end of the quiver so that adjacent arrows arranged in the quiver may be more distantly spaced at the upper end of the quiver than at the lower end of the quiver.

Regarding the closeable compartment, an opening is located proximate to the upper end of the compartment through which access is provided to an interior of the compartment. A flap closure is provided for securably covering the opening. The flap is releasably couplable by a flap coupler to the back exterior surface of the back side of the compartment. The quiver is couplable to the compartment by a quiver coupler located below the flap coupler so that the flap remains openable when the quiver is coupled to the compartment.

It is contemplated that the closeable compartment and the quiver shall be constructed from leather and that the quiver shall be coupled to the compartment by tied leather thongs.

In an alternative embodiment, it is contemplated that the compartment may include a frame contained within a pliable outer shell, and that the frame is sufficiently rigid to establish and maintain the prescribed angle between the front and back exterior surfaces in the configuration described above.

A further embodiment of the present invention is a method for manufacturing a pack that positions arrows for easy grasp by a hunter at a position proximate the hunter's shoulder. The steps of the method include providing a pack that includes a closeable compartment having a front side, a back side, an upper end, a lower end, and an upper and lower depth measured between the front and back sides. The lower depth of the compartment, which is the same as the distance at which the back side extends from the back of the carrying hunter, is greater than the upper depth. This results in the back side of the compartment being oriented at a prescribed angle to the front side. In this configuration, the upper end of the back side is located closer to the front side than the lower end of the back side. An accessory is coupled to the pack so that a longitudinal axis of the accessory is substantially parallel to the back side of the compartment.

The step of coupling the accessory to the pack additionally includes coupling a quiver releasably to the compartment, installing at least one arrow in the quiver so that an upper end of the arrow extends beyond an upper end of the quiver, mounting the pack on a hunter's back, and positioning the pack so that the upper end of the arrow is above the closed compartment and proximate to the hunter's shoulder thereby facilitating the hunter's grasp of the arrow.

Optionally, the method includes canting the upper end of the quiver sidewardly to facilitate a hunter's over-the-shoulder grasp of the arrow.

In summary, among other benefits and features described herein or apparent therefrom, the present invention includes a packable compartment having an inwardly slanting back surface upon which accessories may be mounted so that at least a portion of the mounted accessory will be located proximate to the carrier's shoulder and within easy over-the-shoulder reach. It also provides a means by which the rotational orientation of the quiver may be varied with respect to the compartment to further enhance the combination's ability to place mounted accessories proximate the carrier's shoulder and facilitate right and left handed users. Still further, the present invention may be variably configured to conform to different persons' body structure and posture.

DETAILED DESCRIPTION OF THE PREFERRED EMBODIMENTS

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefor, specific structural and functional details disclosed herein are not to be interpreted as limiting, but merely as a basis for the claims and as a representative basis for teaching one skilled in the art to variously employ the present invention.

Certain terminology will be used in the following description and claims to relate relative orientations. Examples of such terminology include "upwardly", "downwardly", "rightwardly" and "leftwardly" and should be interpreted as though the pack were being viewed from behind and in an upright position. The words "inwardly" and "outwardly" will refer to directions toward and away from, respectively, the geometric center of the structure being referred to. This terminology will include these words, specifically mentioned derivatives thereof, and words of similar import.

In the claims, components of the invention may be recited as being "coupled"; use of this terminology indicates that it is anticipated that elements of the invention may be connected together in such a way that there are other components interstitially located between the connected elements or that the elements may be connected in fixed or movable relation one to the other.

Figure 1:
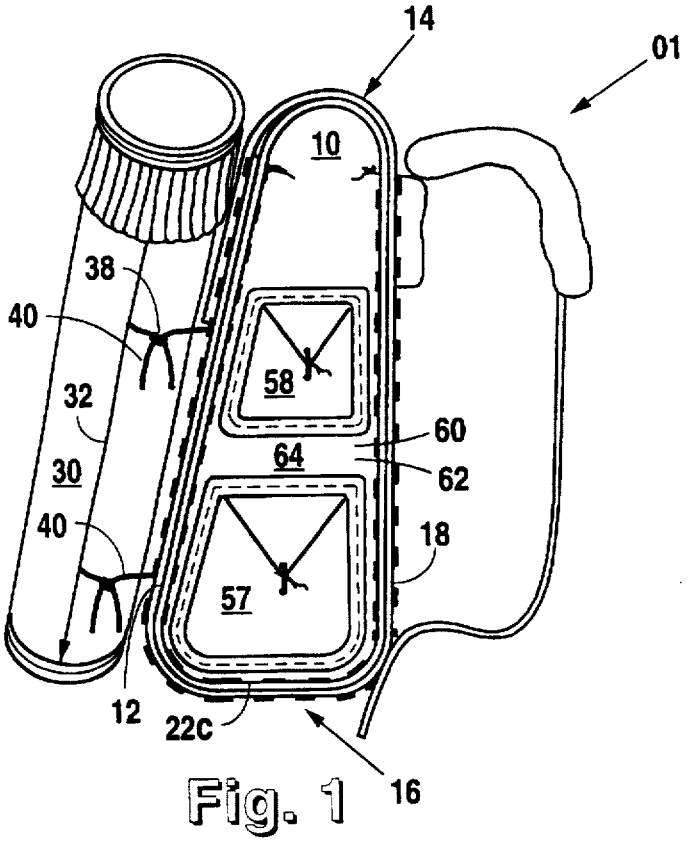
FIG. 1 is a side view of the pack showing the first side panel.
Figure 7:
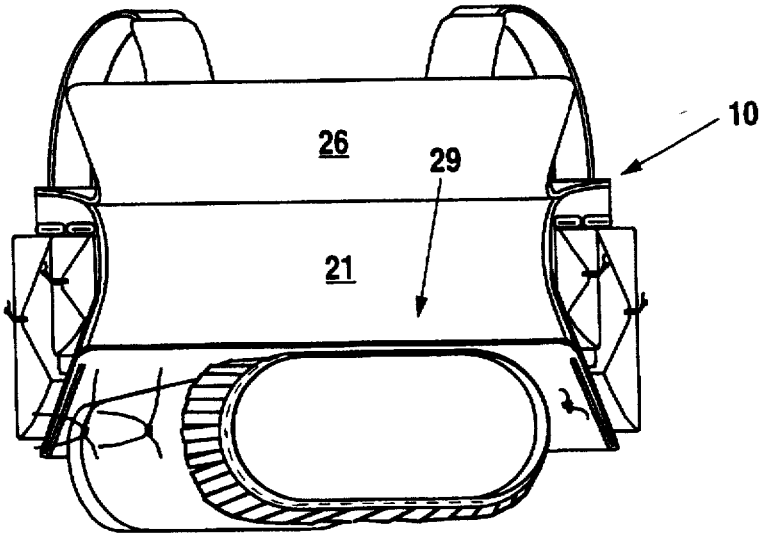
FIG. 7 is a top view of the pack with the flap closure open revealing the interior of the closeable compartment.

Referring to FIGS. 1 and 7, one embodiment of the present invention is illustrated. A pack 01 is shown having a closeable compartment 10 and a quiver 30. The compartment 10 has a back side 12, upper end 14, lower end 16, and front side 18. The back side 12 includes a back exterior surface 22 while the front side 18 includes a front exterior surface 20. A flap closure 26, when in an open position as shown in FIG. 7, reveals an opening 21 to an interior 29 of the closable compartment 10. The interior 29 is sized to house packable items, such as hunting and camping gear. A flap coupler 28 is used to secure the flap closure 26 in the closed position. In the embodiment illustrated in FIG. 2, the flap coupler 28 is a leather thong that is used to tie the flap closure 26 to the back exterior surface 22 of the compartment 10.

A spacing member 60 extends between the back side 12 and front side 18 of the compartment 10. In the embodiment illustrated in the figures, the spacing member 60 comprises a first side panel 62 and a second side panel 66. The panels 62 and 66 are generally triangularly shaped so that an upper end **22*a* of the back surface 22 is positioned closer to a carrying person or hunter 06 than the lower end 22*b*. The front exterior surface 20 and the back exterior surface 22 of the compartment 10 form a prescribed angle 22*c*. The prescribed angle 22*c*** is approximately eighty degrees.

The first side panel 62 has a first exterior side 64 and the second side panel 66 has a second exterior side 70. Each of the sides 64 and 70 in the illustrated embodiment has lower and upper pouches 57, 57', 58, and 58' respectively, for storing packable items.

Figure 6:
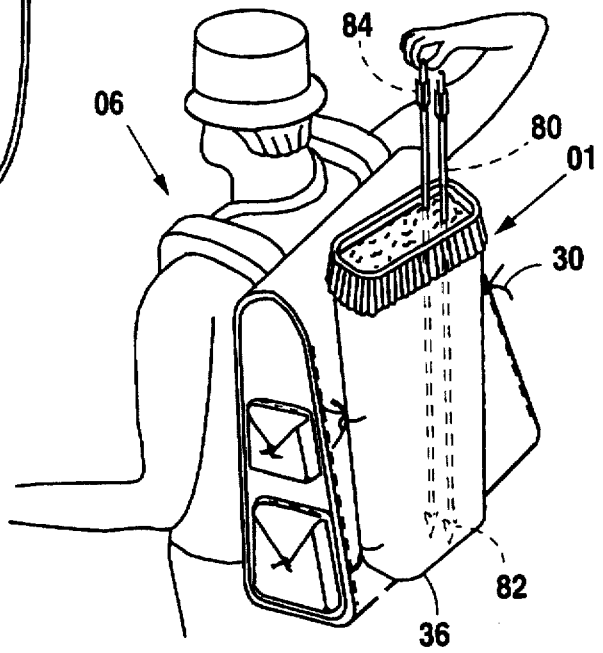
FIG. 6 is a view of the pack mounted on the back of a hunter.

The compartment 10 has carrying straps 50 attached to the front surface 20. As shown in FIG. 6, the straps allow a hunter 06 to conveniently carry upon his or her back the pack 01.

Accessories 30, such as bows, quivers, axes, or guns may be mounted onto the back surface 22. In the illustrated embodiments, the quiver 30 is mounted to the compartment 10. The quiver 30 has an upper end 34, a lower end 36, and a longitudinal axis 32 extending therebetween. The longitudinal axis 32 is orientated substantially parallel to the back exterior surface 22 of the compartment 10.

Arrows 80 are placeable in the quiver 30. The arrow 80 has a lower end 82 and an upper end 84. The lower end 82 has a point and is positioned inside the quiver 30 at the quiver's lower end 36. The upper end 84 extends outside of the quiver 30.

The upper end 34 of the quiver 30 has a greater width than the lower end 36 of the quiver 30. The difference in end widths helps spread the upper ends 84 of the arrows 80 one from the other making them easier to grasp.

Figure 2:
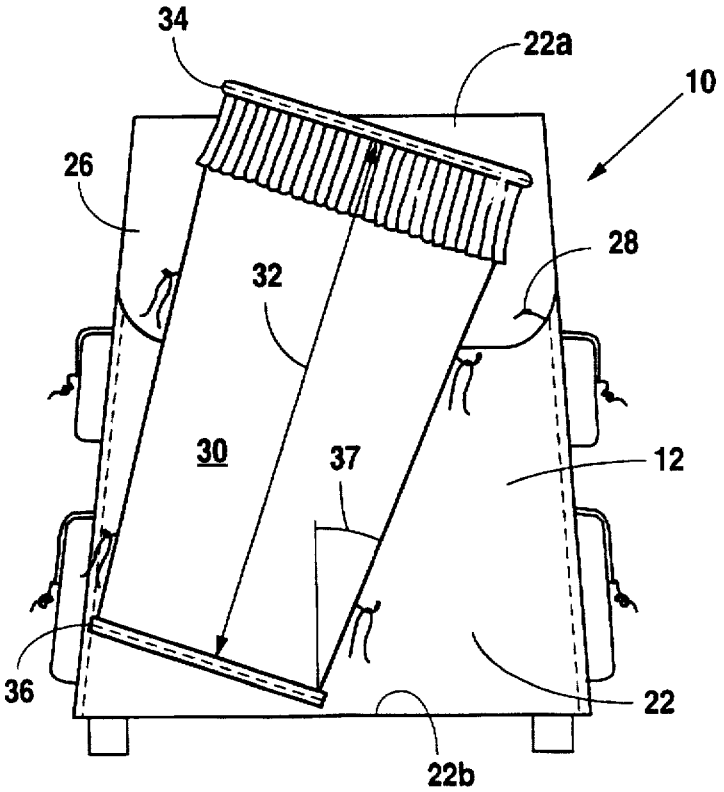
FIG. 2 is a back view of the pack with a quiver mounted on the back exterior surface.
Figure 3:
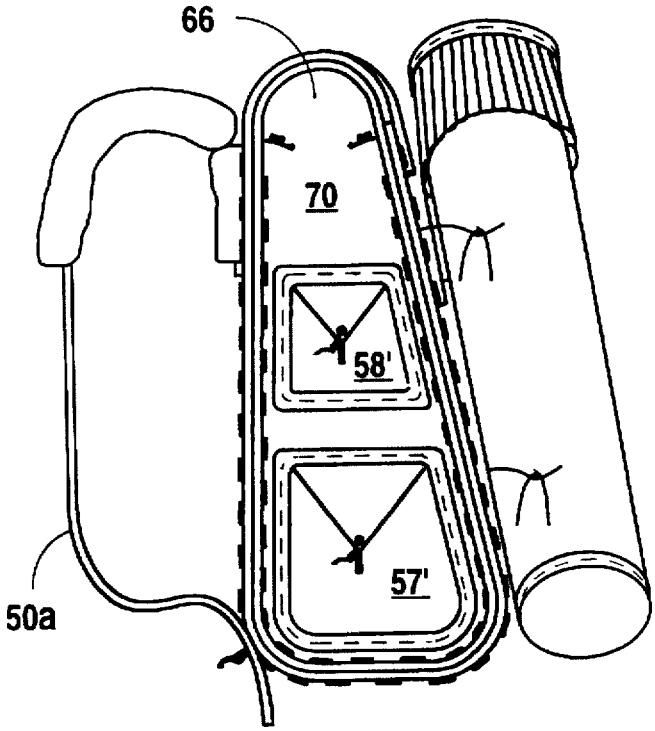
FIG. 3 is a side view of the pack showing the second side panel.
Figure 4:
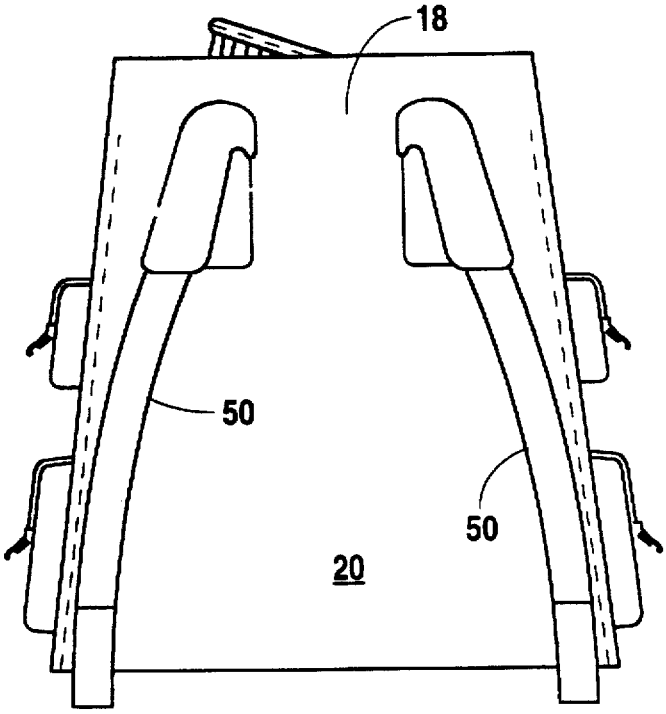
FIG. 4 is a front view of the pack with a pair of carrying straps.

The quiver 30 is positioned on the back exterior surface 22 to form an acute angle 37 to the vertical. This angle 37 positions the upper end 84 of the arrow 80 for easy over-the-shoulder reach and grasp of a carrying person 06. Referring to FIG. 2, the quiver 30 is mounted with its upper end 34 canted rightwardly so that the arrows 80 are within easy grasp of a right-handed hunter 06. In an alternative embodiment, the quiver 30 is mounted with its upper end 34 leftwardly canted so that the arrows 80 are within easy grasp of a left-handed hunter 06.

Preferably the pack 01 is constructed from leather. Leather straps 50 allow a hunter 06 to conveniently carry the pack 01 upon his or her back. A quiver coupler 38 is used to tie the quiver 30 to the compartment 10. In one embodiment, the quiver coupler 38 is leather thongs 40 as shown by FIG. 1, which are used to tie the quiver 30 to the compartment 10. The quiver 30 can be detached from the compartment 10. The feature of the angled back side 12 allows a person 06 to hunt while traveling to and from camp. Once at the campsite, the hunter 06 can detach the quiver 30 from the compartment 10. A carrying strap coupler allows a hunter 06 to alternatively attach carrying straps 50*a* to the quiver 30. The carrying straps 50*a* give a hunter 06 the option to carry the quiver 30 without the compartment 10.

It is contemplated that the straps 50 of the closeable compartment 10 can be releasable and exchangeable between the compartment 10 and the quiver 30, if it is desired to use one separately from the other.

Figure 5:
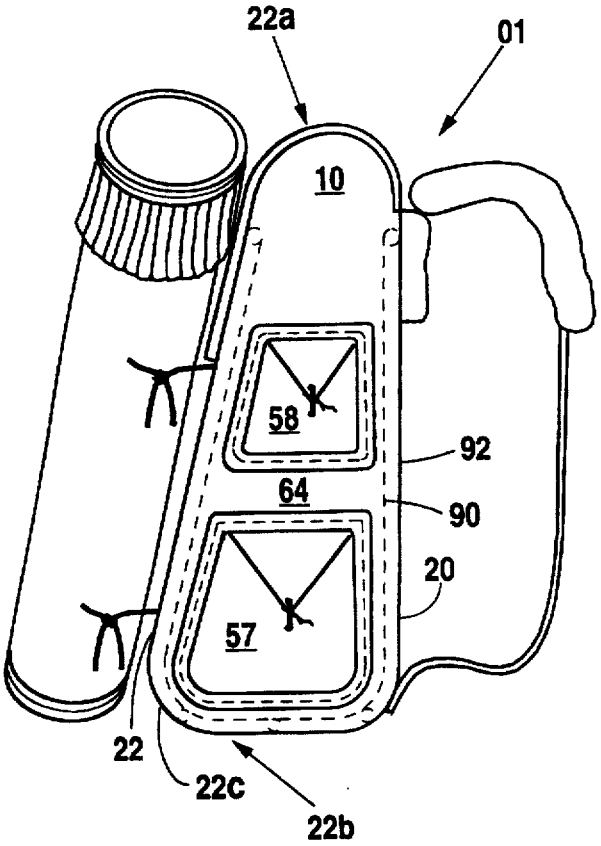
FIG. 5 is another embodiment of the pack with a frame contained within a pliable outer shell.

In the embodiment of the present invention illustrated in FIG. 5, a pliable outer shell 92 of the pack 01 is placed over a frame 90. The frame 90 may be made out of a hard plastic tubular material, while the outer shell 92 may be manufactured out of a synthetic material such as nylon. The frame is constructed so that back exterior surface 22 forms an angle 22*c* with the front exterior surface 20; just as in the embodiment in which the components of the pack are constructed from leather. This angled construction places the upper end 22*a* closer to a person 06 than the lower end 22*b*.

A further embodiment of the present invention is a method of providing a pack 01 that positions arrows for easy grasp by a hunter at a position proximate to the hunter's shoulder. In one embodiment, the pack 01 is manufactured with only the closeable compartment 10. Various accessories 30 can be mounted onto the compartment 10 at the time of manufacture or can be added later by retailers. In another embodiment, the pack 01 includes both the closeable compartment 10 and an accessory 30, such as a quiver 30, connected to the back exterior surface 22.

The quiver 30 is mounted at a transverse angle 37 to the vertical. The quiver can be positioned to accommodate a left-handed or right-handed hunter 06. Arrows 80 can be placed in the quiver 30 for use during hunting.

It is to be understood that while certain forms of the present invention have been illustrated and described herein, it is not to be limited to the specific forms or arrangement of parts described and shown. These and other variations, which will be appreciated by those skilled in the art, are within the intended scope of this invention.

What is claimed is:

1. A combination back pack and quiver to be carried on a person's back; said combination comprising:

a closeable compartment suitable for having accessories mounted on a back side thereof; said closeable compartment comprising:

an upper end and a lower end;

a front side having a front exterior surface for resting upon a carrying person's back;

a back side having a back exterior surface, said back side being oriented for location away from a carrying person's back;

carrying straps coupled to said closeable compartment for holding said pack upon a carrying person's back and locating said upper end of said closeable compartment proximate to a carrying person's shoulder;

at least one spacing member coupled between said front side and said back side for orienting said back exterior surface with respect to said front exterior surface;

said back exterior surface being oriented at a prescribed angle with respect to said front exterior surface so that an upper end of said back exterior surface is located closer to said front exterior surface than a lower end of said back exterior surface, said prescribed angle being of sufficient degree to assure that accessories coupled to and substantially parallel with said back exterior surface and extending thereabove will be canted forward and at least partially located within easy over-the-shoulder reach of a carrying person when said pack is being worn;

a quiver coupled to said back side of said closeable compartment and positioned thereupon so that a longitudinal axis of said quiver is oriented substantially parallel to said back exterior surface of said closeable compartment;

an open upper end of said quiver being forwardly positioned with respect to a lower end of said quiver;

said longitudinal axis of said quiver being canted sidewardly at an acute angle to vertical placing said upper end of said quiver adjacent to a shoulder of the carrying person; and at least one arrow positioned within said quiver, said arrow having a lower end and an upper end, said upper end extending above said closeable compartment.

2. The pack as recited in claim 1; further comprising:

a frame contained within a pliable outer shell, said frame being sufficiently rigid to establish and maintain said prescribed angle between said front and back exterior surfaces.

3. The combination back pack and quiver as recited in claim 1; wherein said spacing member further comprises:

a first side panel establishing a first exterior side of said pack, said first side panel being constructed from material sufficiently rigid to establish and maintain said prescribed angle between said front and back exterior surfaces.

4. The combination back pack and quiver as recited in claim 3; wherein said spacing member further comprises:

a second side panel oppositely oriented to said first side panel, said second side panel establishing a second exterior side of said pack, said second side panel being constructed from material sufficiently rigid to establish and maintain said prescribed angle between said front and back exterior surfaces.

5. The combination back pack and quiver as recited in claim 4; wherein said first and second side panels are selectable with respect to size and shape thereby allowing the orientation of the back exterior surface to be adjustable.

6. The combination back pack and quiver as recited in claim 4; wherein said first and second side panels are constructed from leather.

7. The combination back pack and quiver as recited in claim 1; further comprising:

a quiver coupler wherein said quiver coupler allows adjustable positioning of said quiver with respect to said closeable compartment.

8. The combination back pack and quiver as recited in claim 1; wherein said upper end of said quiver is rightwardly positioned with respect to a lower end of said quiver.

9. The combination back pack and quiver as recited in claim 1; wherein said upper end of said quiver is leftwardly positioned with respect to a lower end of said quiver.

10. The combination back pack and quiver as recited in claim 1 wherein said upper end of said at least one arrow extending forward of said front exterior surface of said closeable compartment.

11. The combination back pack and quiver as recited in claim 10; wherein said upper end of said quiver tapers down to said lower end of said quiver so that adjacent arrows arranged in said quiver may be more distantly spaced at said upper end of said quiver than at said lower end of said quiver.

12. The combination back pack and quiver as recited in claim 1; further comprising:

an opening located proximate to said upper end of said closeable compartment through which access is provided to an interior of said compartment;

a flap closure for securably covering said opening, said flap closure being releasably couplable by a flap coupler to said back exterior surface of said back side; and said quiver couplable to said compartment by a quiver coupler located below said flap coupler so that said flap remains openable when said quiver is coupled to said compartment.

13. The combination back pack and quiver as recited in claim 1; wherein said closeable compartment and said quiver is constructed from leather and said quiver is coupled to said compartment by tied leather thongs.

14. A method for providing a combination back pack and quiver that positions arrows for easy grasp by a hunter at a position proximate the hunter's shoulder; said method comprising:

providing a pack that includes a closeable compartment having a front side, a back side, an upper end, a lower end, an upper and lower depth wherein each depth is measured between said front and back sides and said lower depth is greater than said upper depth whereby said back side of said compartment is oriented at a prescribed angle to said front side so that said upper end of said back side is located closer to said front side than said lower end of said back side; and coupling an accessory to said pack so that a longitudinal axis of said accessory is substantially parallel to said back side of said compartment;

coupling a quiver having an arrow installed therein to said compartment so that an upper end of said arrow extends beyond an upper end of said quiver;

mounting said pack on a hunter's back; and positioning said pack so that said upper end of said arrow is positioned above said closed compartment and proximate to the hunter's shoulder thereby facilitating the hunter's grasp of said arrow.

15. The method as recited in claim 14, further comprising the step of canting said upper end of said quiver sidewardly to facilitate a hunter's over-the-shoulder grasp of said arrow.

16. A combination back pack and quiver to be carried upon a person's back, said combination comprising:

a closeable back pack compartment adapted to be positioned adjacent to a carrier's back, said compartment having a back exterior surface to be located away from the carrier's back; and a quiver coupled to said back exterior surface of said compartment and oriented so that an upper end of said quiver is forwardly positioned with respect to a lower end of said quiver and so that a longitudinal axis of said quiver is sidewardly canted at an acute angle to vertical for positioning said upper end of said quiver adjacent to the carrier's shoulder; and at least one arrow carried within said quiver, said at least one arrow extending above the carrier's shoulder for easy grasping.

* * * * *